US006009736A

United States Patent [19]

Ginzburg

[11] Patent Number: 6,009,736

[45] Date of Patent: Jan. 4, 2000

[54] SUPERLARGE COIL HANDLING SYSTEM FOR HOT STRIP MILL

[75] Inventor: Vladimir B. Ginzburg, Pittsburgh, Pa.

[73] Assignees: Danieli United A Division of Danieli Corporation; International Rolling Mill Consultants, Inc., both of Pittsburgh, Pa.

[21] Appl. No.: 09/309,098

[22] Filed: May 10, 1999

Related U.S. Application Data

[63] Continuation-in-part of application No. 09/134,791, Aug. 14, 1998.

[51] Int. Cl.[7] ..... B21C 47/00

[52] U.S. Cl. ..... 72/148; 72/146; 242/533.4

[58] Field of Search ..... 72/146, 148, 200, 72/201, 202, 229, 234, 231, 208, 97; 29/527.7; 242/527.5, 533.4, 533.5

[56] References Cited

U.S. PATENT DOCUMENTS

| | | | |
|---|---|---|---|
| 2,658,741 | 11/1953 | Schmidt et al. | 263/3 |
| 2,834,558 | 5/1958 | Halpin | 242/527.5 |
| 3,049,314 | 8/1962 | Criger | 72/148 |
| 3,803,891 | 4/1974 | Smith | 72/231 |
| 3,805,570 | 4/1974 | Smith | 72/146 |
| 4,005,830 | 2/1977 | Smith | 242/78.1 |
| 4,019,865 | 4/1977 | Smith | 72/231 |
| 4,297,865 | 11/1981 | Smith | 72/146 |
| 4,306,438 | 12/1981 | Child et al. | 72/146 |
| 4,442,690 | 4/1984 | Hirschmanner et al. | 72/128 |
| 4,491,005 | 1/1985 | Kimura et al. | 72/201 |
| 4,761,983 | 8/1988 | Ginzburg et al. | 72/148 |
| 5,329,688 | 7/1994 | Arvedi et al. | 72/201 |

FOREIGN PATENT DOCUMENTS 1269648 4/1975 United Kingdom .

*Primary Examiner*—Rodney Butler
*Attorney, Agent, or Firm*—Armstrong, Westerman Hattori, McLeland & Naughton

[57] ABSTRACT

A method and apparatus for processing continuously cast thin or intermediate thickness gauge slabs into finished continuous hot-rolled strip in superlarge coil form. Optimum entry speed of continuous cast slabs into the hot rolling mill is enabled and substantially uninterrupted operation of the continuous caster is provided for; problems associated with welded coil ends during subsequent processing are reduced with use of the finished superlarge coils.

16 Claims, 11 Drawing Sheets

SUPERLARGE COIL HANDLING SYSTEM FOR HOT STRIP MILL

This application is a continuation-in-part of co-pending U.S. patent application, Ser. No. 09/134,791, filed Aug. 14, 1998.

FIELD OF THE INVENTION

This invention relates to method and apparatus for coiling work product of a continuous caster into superlarge coils, and uncoiling such superlarge coils for subsequent processing, so as to optimize operations for continuous strip casting and hot-rolling.

DESCRIPTION OF RELATED ART

Prior practice for producing continuously cast thin slabs and further processing them into hot-rolled strip included periodic shearing of the thin slab so as to obtain hot-rolled strip coils of a size and weight within capacities of subsequent processing equipment. Such coil size results in numerous coil-to-coil end welds and their inherent problems during subsequent processing of the strip. Process and apparatus of pending parent patent application Ser. No. 09/134,791 titled "Apparatus and Method for Producing and Handling Superlarge Coils of Metal Strip", the contents of which are incorporated herein by reference, enable use during subsequent processing of the strip of superlarge coils of a specific weight up to about 8,000 pound per inch of width. Such superlarge coils substantially reduce the number of coil-to-coil end welds and their inherent problems.

Prior practice for continuous casting and subsequent hot rolling makes use of a reheat tunnel furnace following the continuous caster to obtain proper slab temperature and uniformity of temperature for hot-rolling operations.

To carry out a similar heating operation for a continuous cast thin slab, many times longer than that of prior practice, in preparation for hot rolling into metal strip of a superlarge coil, a reheat tunnel furnace of unreasonable length would be required.

Alternatively, carrying out hot rolling operations on a continuous basis, as thin cast slab continuously exits a continuous caster, does not enable optimum entry speed of the cast thin slab into the rolling mill, as continuous casting speed is usually limited to about 6 meters/minute which is significantly less than the optimum entry speed for a hot-rolling mill.

SUMMARY OF THE INVENTION

This invention alleviates the problems of prior practice continuous casting and hot rolling through use of apparatus and methods for supporting, coiling, transporting and uncoiling superlarge coils to link a continuous casting process with hot-rolling operations. Continuously cast thin metal slabs are reheated then coiled into superlarge coil form at a coiling station followed by repositioning to an uncoiling station for entry at optimum speed into a hot-rolling mill. Repeating such coiling, repositioning and uncoiling sequence enables uninterrupted operation of a thin slab continuous caster.

BRIEF DESCRIPTION OF THE DRAWINGS

Specific apparatus and procedures of the invention are described in more detail with reference being made to the accompanying drawings.

IN THE DRAWINGS

Figure 1:
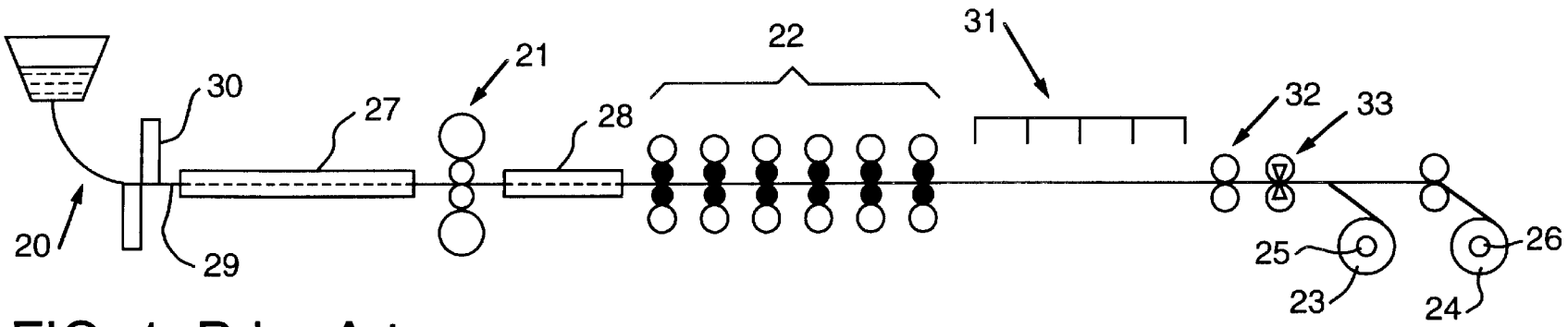
FIG. 1 Prior Art
Figure 2:
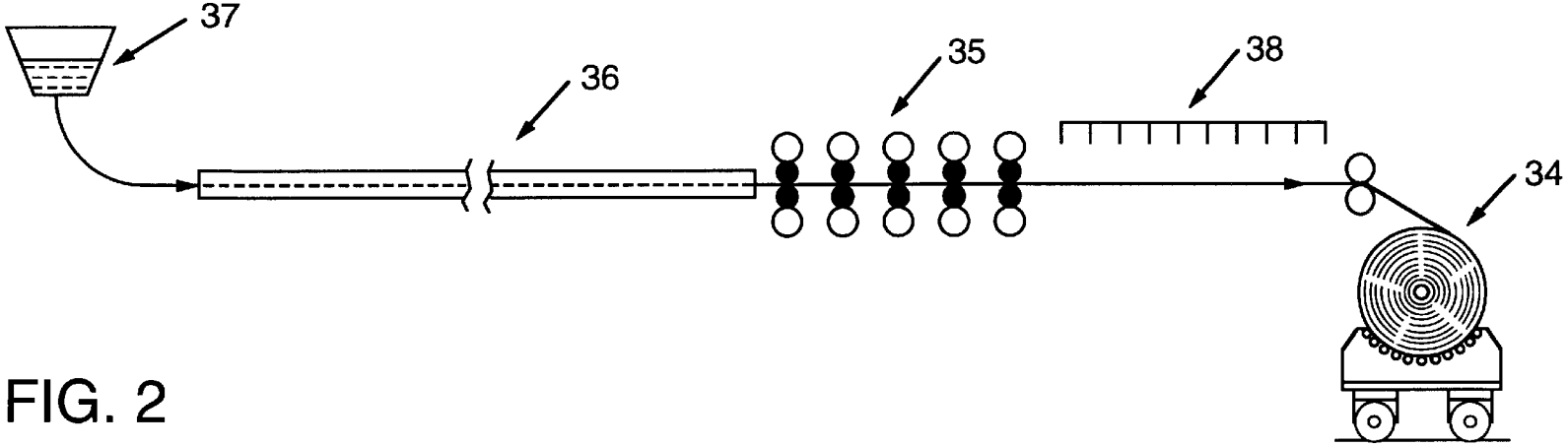
Figure 3:
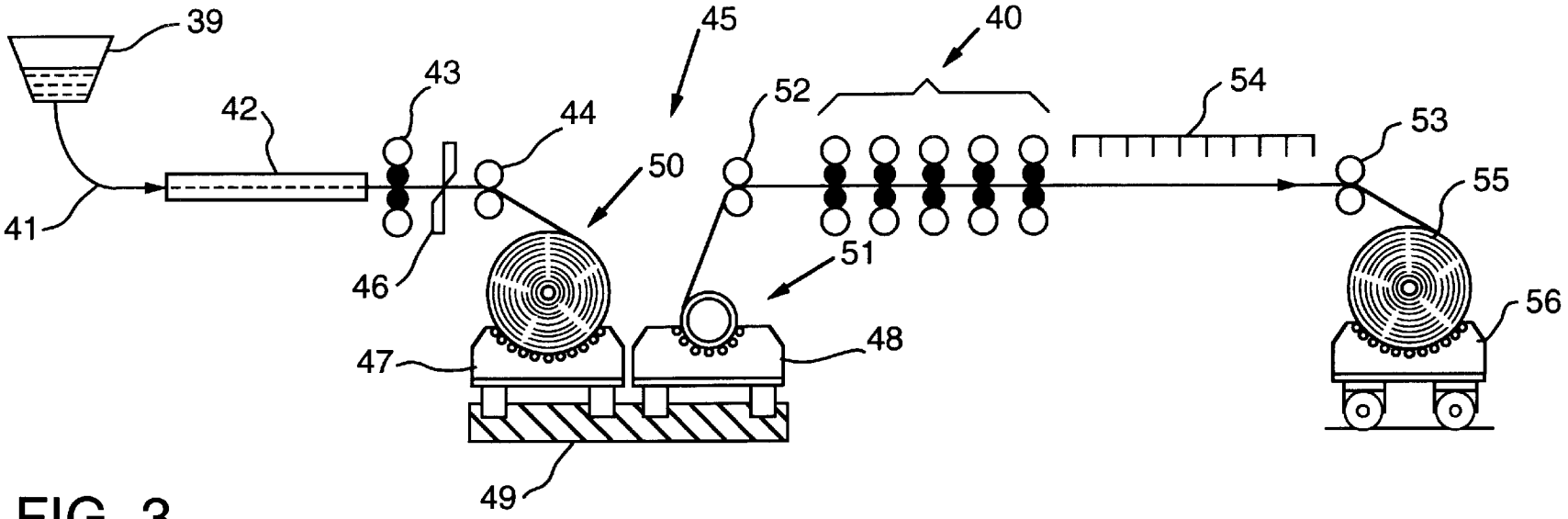
Figure 4:
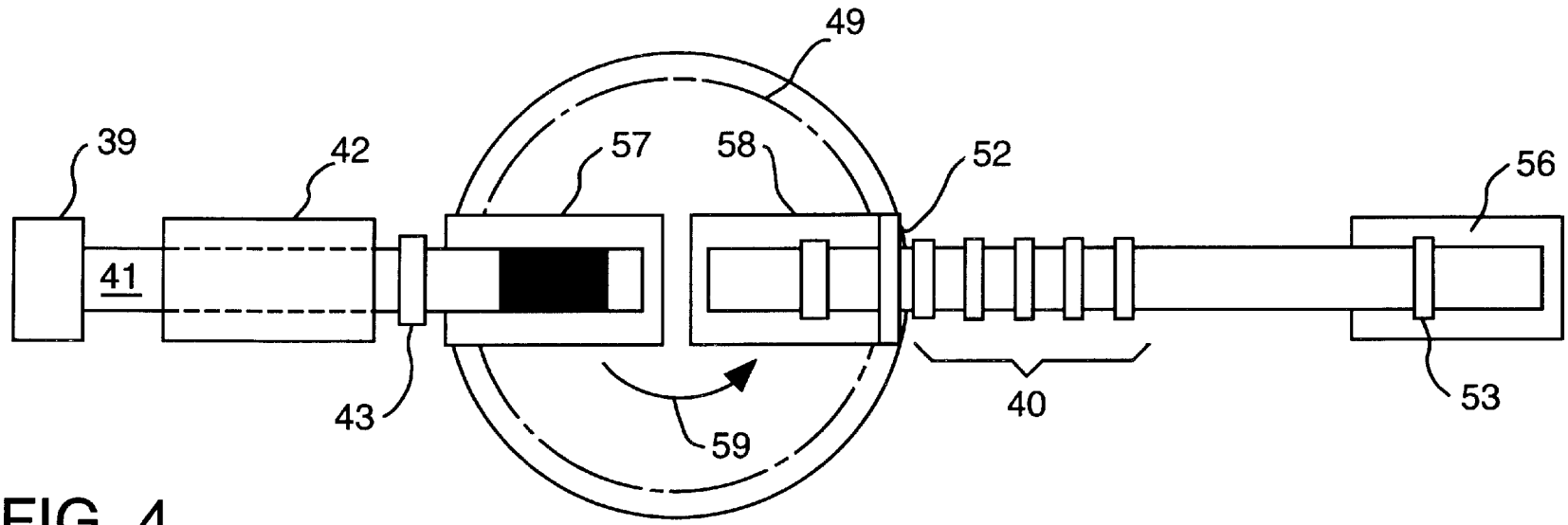
Figure 4A:
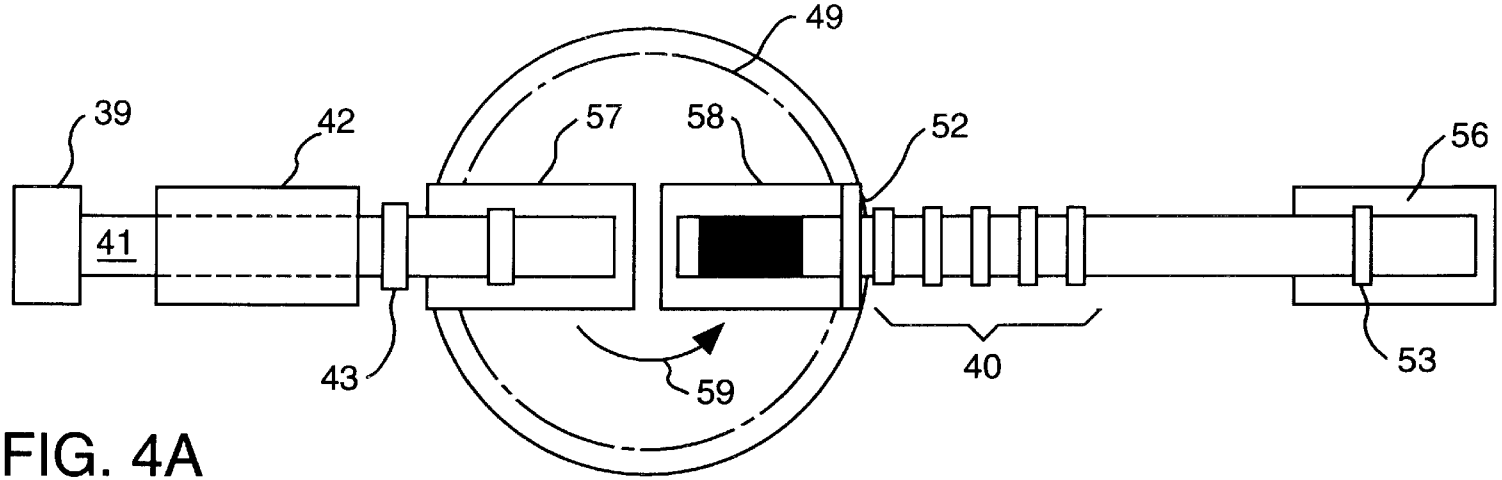
Figure 4B:
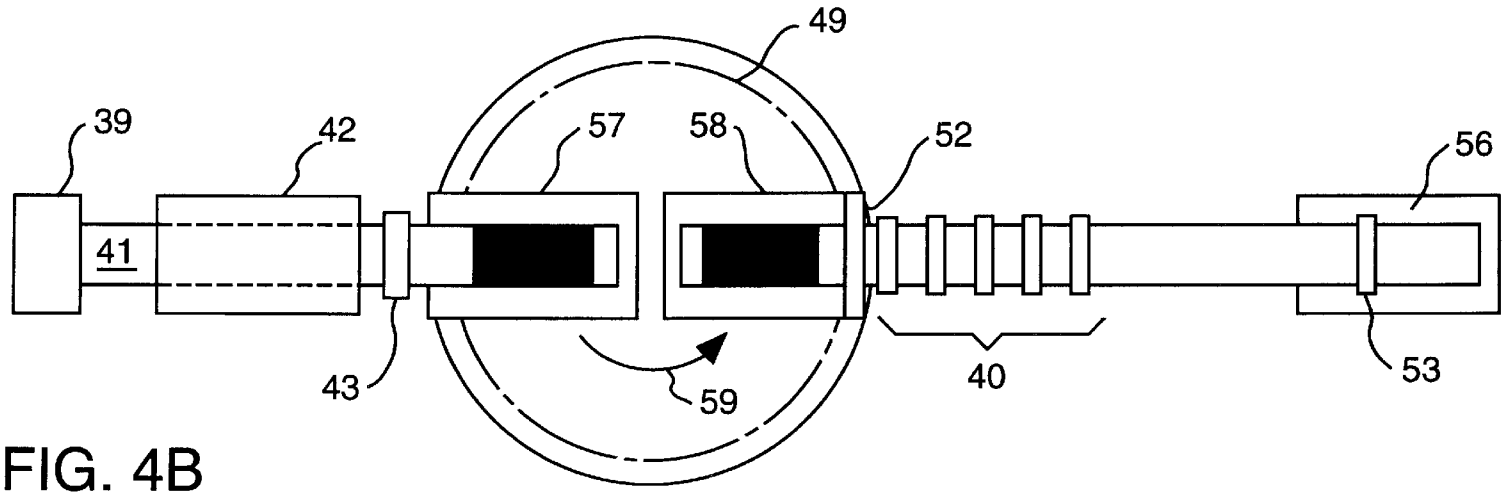
Figure 5:
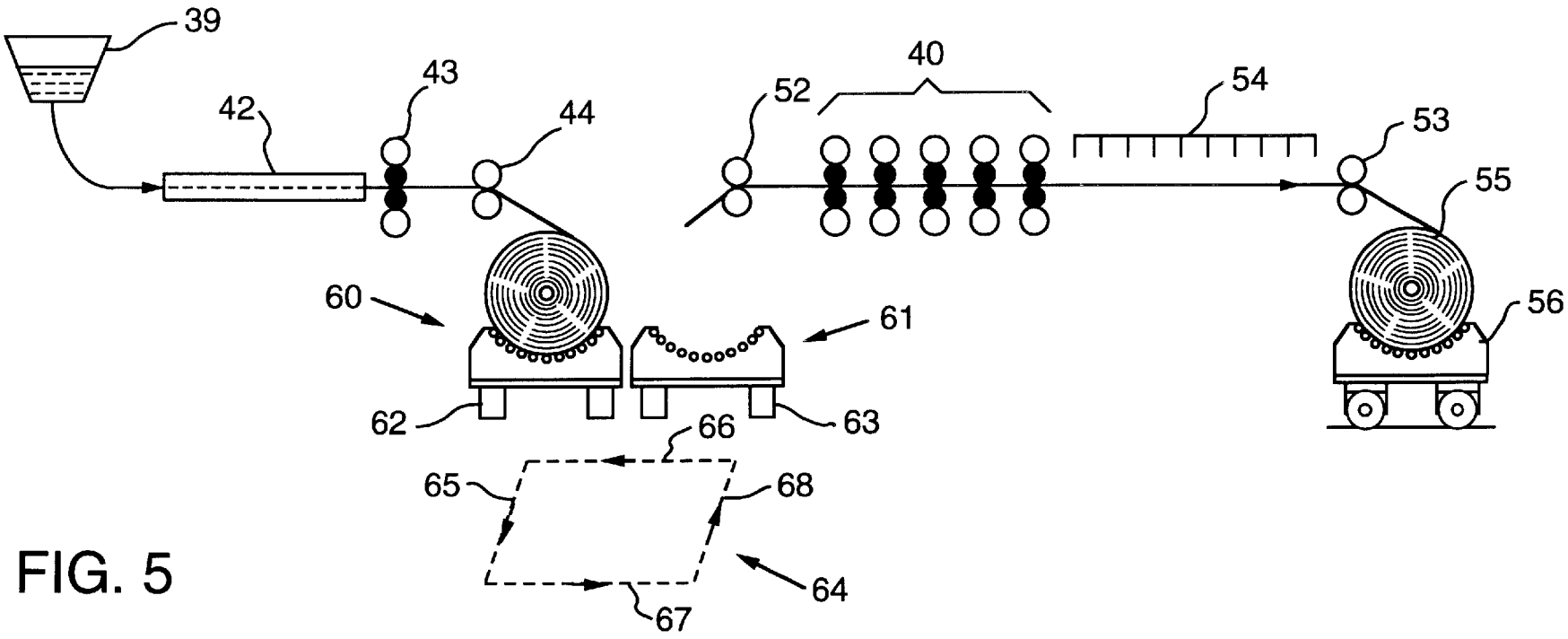
Figure 5A:
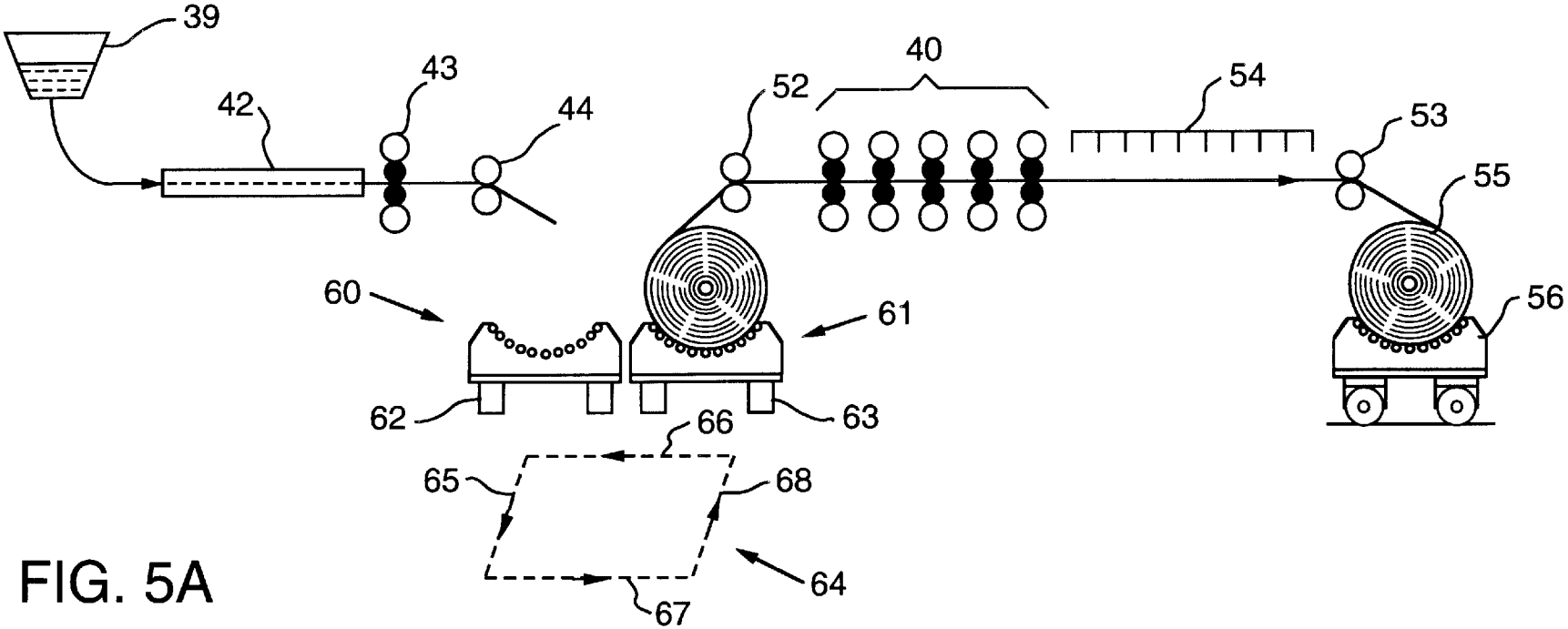
Figure 5B:
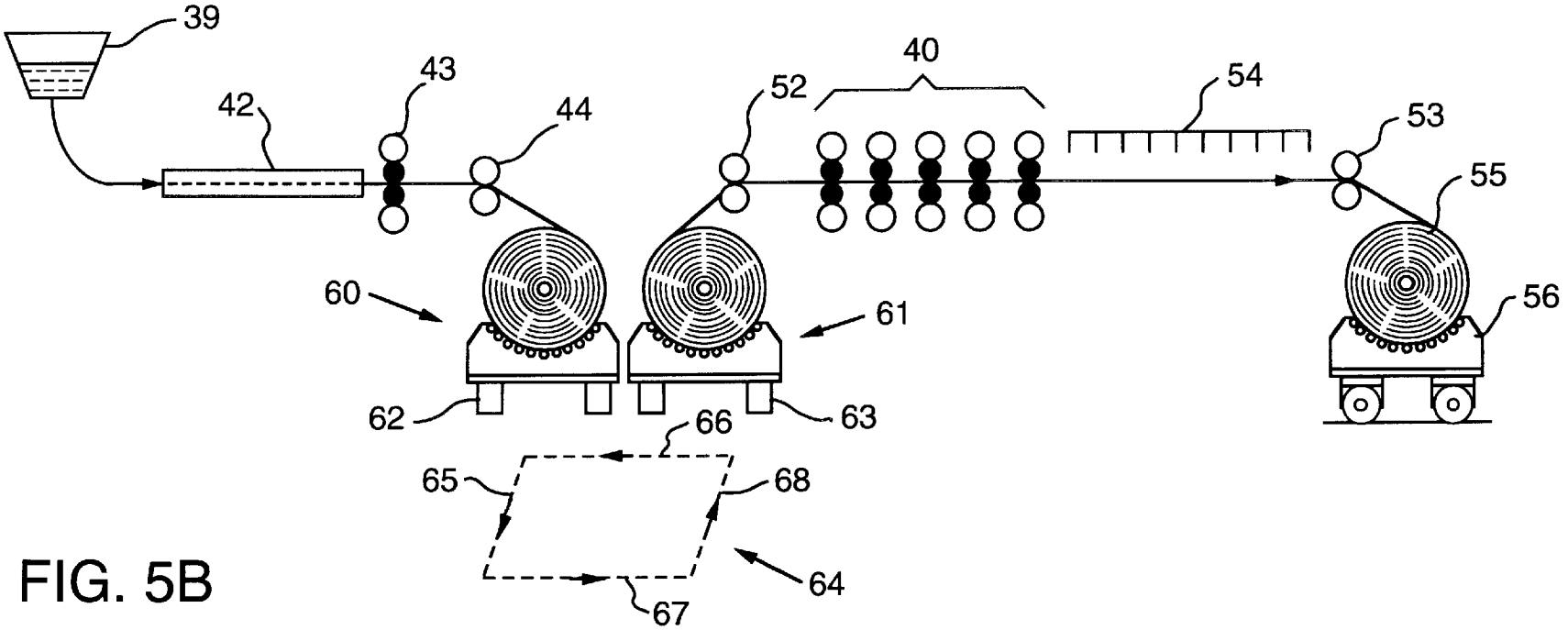
Figure 6:
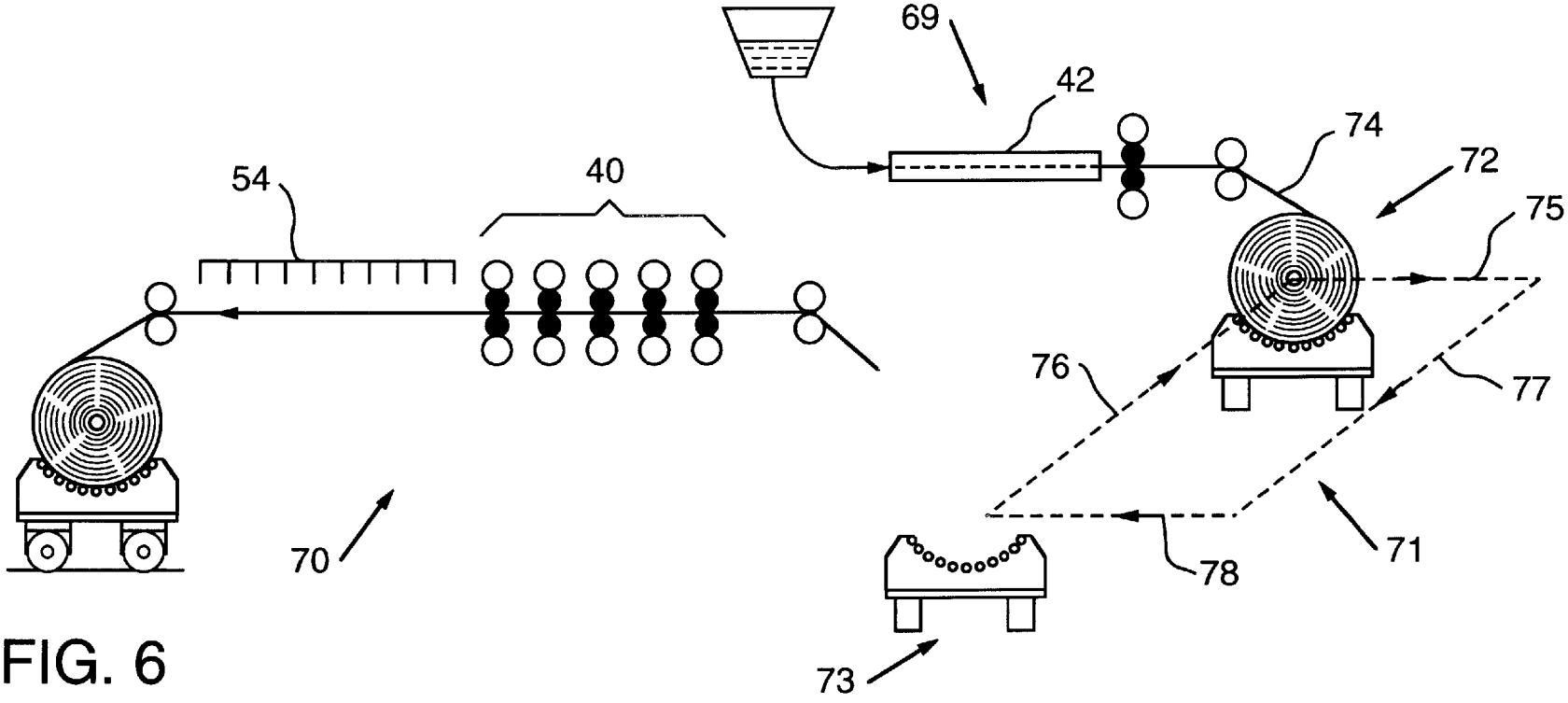
Figure 6A:
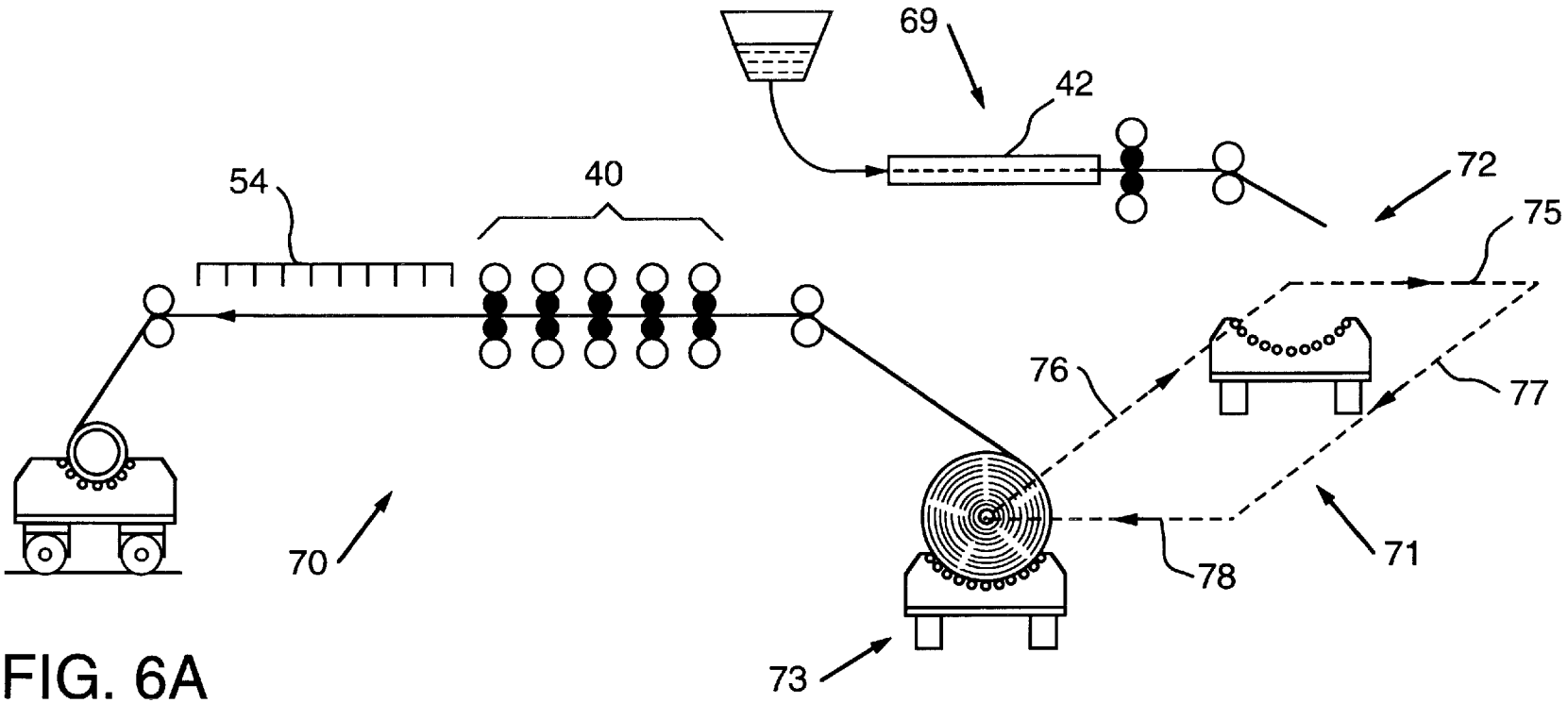
Figure 6B:
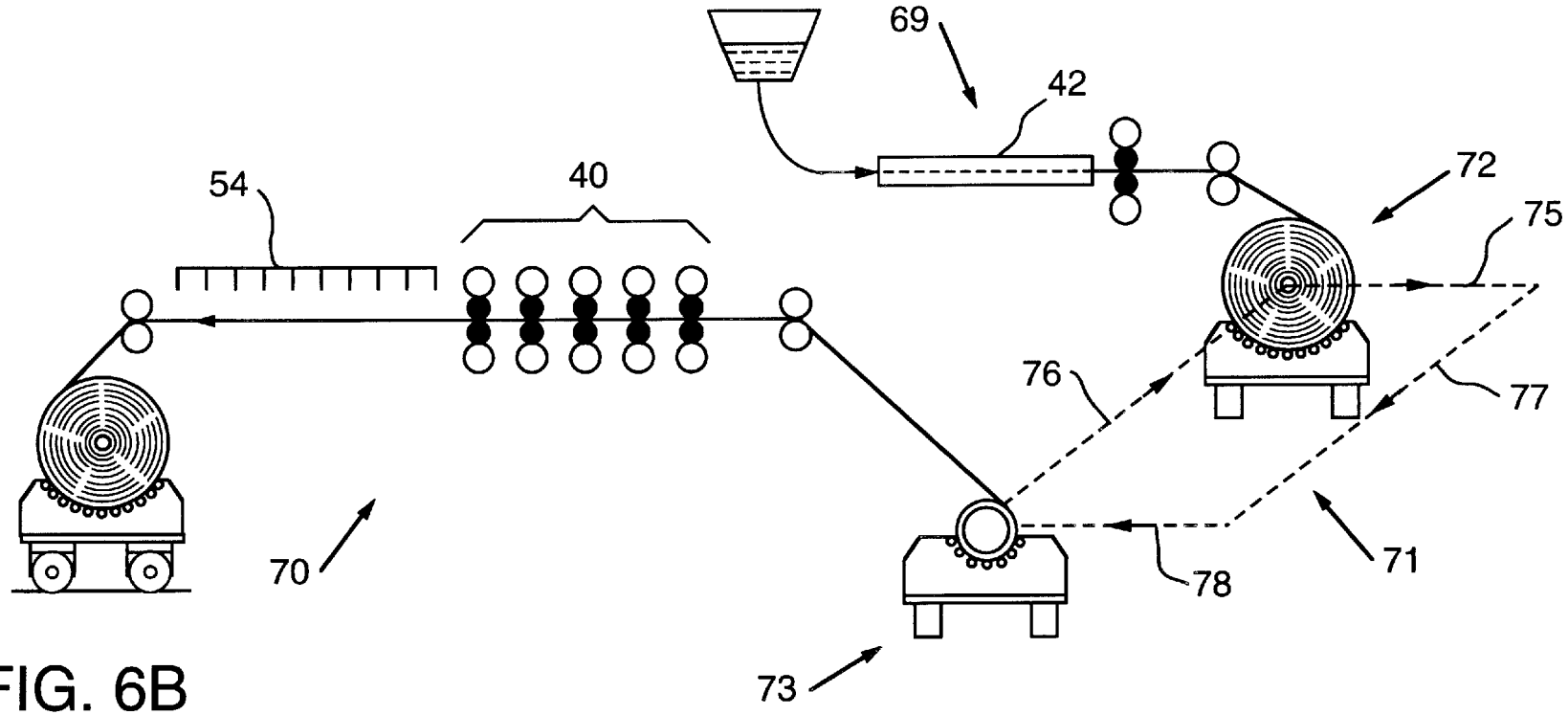
Figure 7:
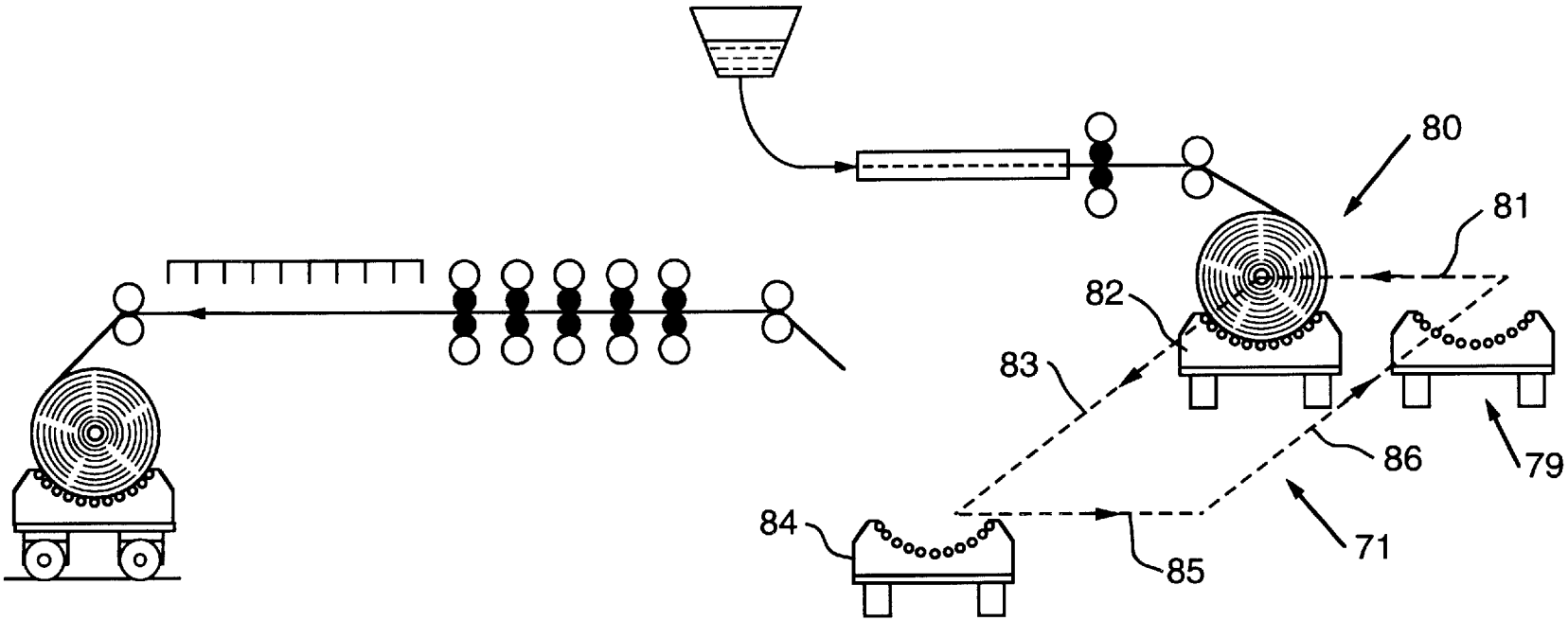

FIG. 1, is a schematic drawing in elevational view of a prior art continuous casting and rolling operation;

FIG. 2, is a schematic drawing in elevational view of a continuous casting and rolling operation for pointing out reheating requirements associated with production of superlarge coils as exemplified in the pending parent application;

FIG. 3, is a schematic drawing in elevational view of a continuous casting, superlarge coil handling and hot-rolling system of the invention;

FIGS. 4, 4*a* and 4*b* are schematic drawings in plan view of sequential steps in a turret repositioning system of the invention for interchanging superlarge coil supporting and handling devices;

FIGS. 5, 5*a* and 5*b* are schematic drawings, in perspective, of sequential steps in a superlarge coil supporting and handling system of the invention for use in straight-line processing operations;

FIGS. 6, 6*a* and 6*b* are schematic drawings, in perspective, of sequential steps in a superlarge coil supporting and handling system of the invention for use in non-straight-line processing operations;

FIG. 7, is a schematic drawing, in perspective, of the system of FIGS. 6, 6*a* and 6*b* wherein a third superlarge coil supporting and handling device is incorporated.

DETAILED DESCRIPTION OF THE INVENTION

Prior art continuous casting and rolling facilities for cast thin slabs as depicted in FIG. 1, comprise continuous caster 20, roughing mill 21, hot rolling mill 22, and finished coils 23 and 24 on coiling mandrels 25 and 26 respectively. Reheat tunnel furnace 27 and temperature equalizing furnace 28 provide proper and uniform temperature throughout continuously cast thin slab 29. Shear 30 provides a means to sever the continuously cast thin slab into pre-determined lengths to enable operation of the hot-rolling mill at an optimum slab entry speed, which is significantly greater than a speed of the continuous caster, and to provide thin cast slabs of a length and weight acceptable for down-stream finishing operations equipment. Such severed slabs are brought to the proper hot-rolling temperature in reheat furnace 27 which is of a length sufficient to accommodate the entire slab in order that its temperature is uniform throughout. The reheated slabs are reduced in thickness gauge at roughing mill 21, equalized in temperature in furnace 28 and rolled at hot-rolling mill 22. All such rolling steps are carried out at pre-determined optimum rolling speeds, independent of continuous casting speed, as the slab is severed from the portion exiting the caster. Following thickness gauge reduction, in the hot rolling mill the continuous strip is cooled at cooling system 31 prior to coiling. Coiling of the hot-rolled strip is alternated between mandrels 25 and 26 so as to enable uninterrupted operation of the hot rolling mill during handling of finished coils. Pinch rolls 32 maintain strip tension and strip movement during coil changes and flying shear 33 trims ends of the strip prior to coiling In FIG. 2, a coil handler for supporting, coiling, transporting and uncoiling superlarge coils, the subject of the pending parent application, Ser. No. 09/134,791, is depicted at 34. Use of such superlarge coils reduces inherent problems experienced with welded coil ends associated with coils of a size described in relation to FIG. 1. A superlarge coil can have a specific weight from about 1500 to 8000 pound per inch of width, and production of such superlarge coils using a reheating and hot-rolling process as described above and depicted in FIG. 1 would require a reheat tunnel furnace of unreasonable length, as the entire thin cast slab to be rolled at hot-roll mill 35 must be at a uniform temperature throughout its entire length prior to entry into the hot-rolling mill. A reheat tunnel furnace of such length is depicted (in shortened view) at 36 of FIG. 2 in line with a continuous caster at 37 and a cooling system at 38, for cooling the strip prior to coiling, at 34. Requirements for a reheat tunnel furnace, as depicted in FIG. 2, make such depicted method of operation impractical as the continuously cast thin slab can be of a length of more than 600 feet and a furnace of such length would be required to uniformly heat such slab.

FIG. 3, schematically depicts the processing system and apparatus of the present invention which eliminates the need for the impractical process described above. In such system the relatively slow process of continuously casting a thin slab, at 39, is combined with the significantly faster process of rolling at hot-rolling mill 40 such that both processes are operated at optimum conditions.

The process of the invention comprises continuously casting thin slab 41 at continuous caster 39 followed by reheating the slab in relatively short reheat tunnel furnace 42 to about or slightly above a temperature for subsequent hot-rolling at hot-rolling mill 40.

Roughing mill 43 reduces the thickness gauge of the cast slab and pinch rolls 44 direct slab 41 to superlarge coil handling stations generally indicated at 45. Shear 46 severs the reduced thickness thin slab when a superlarge coil approaches finished size. Coil handling apparatus at 45 comprises superlarge coil handlers 47 and 48 disposed on revolvable turret 49. Coil handlers 47 and 48 support, coil, and uncoil superlarge coils at coiling and uncoiling stations 50 and 51 respectively with use of driven rollers arranged to form a supporting cradle. The superlarge coil at 50 presents relatively little exposed surface area at which heat loss can occur thus the temperature established at furnace 42 is substantially maintained until subsequent hot rolling at 40. In a preferred embodiment of the invention depicted in FIGS. 4, 4*a* and 4*b* a superlarge coil of thin cast slab from the continuous caster is transferred by a revolving turret 49 from a coiling station to an uncoiling station, in preparation for hot rolling. Such turret revolves about 180° about its central vertical axis. Such 180° revolution is carried out for straight-line processing configurations, however, other processing equipment configurations are not ruled out by the invention. Following such revolving, the superlarge coil is positioned at an uncoiling station indicated at 51 of FIG. 3, in preparation for thickness gauge reduction at hot-rolling mill 40. Strip handling and processing means to carry out such hot-rolling operation include pinch rolls 52 and 53, and strip cooler 54. The process and apparatus of the invention enables optimum entry speed of the reduced thickness thin slab into rolling mill 40 by enabling separation of the continuous casting process from the hot-rolling process. Finished superlarge coil 55 is supported and coiled using superlarge coil handler 56 which also includes transportation and uncoiling means for use in subsequent strip processing. Such coiling can be initiated with use of a mandrel and completed with the superlarge coil handler through use of driven rollers incorporated in such handler. Such finished superlarge coil handler are the subject of pending parent application Ser. No. 09/134,791.

Sequential steps carried out for handling superlarge coils intermediate the continuous casting process and hot-rolling process are depicted in schematic plan views of FIGS. 4, 4*a* and 4*b*. In FIG. 4, coiling of continuous thin slab caster output is carried out at coiling station 57 and uncoiling station 58 is not in use. Following completion of coiling a superlarge coil of cast thin slab, turret 49 is revolved, as indicated by arrow 59, to position the superlarge coil for uncoiling at uncoiling station 58; such positioning is indicated in FIG. 4*a*. coiling station 57 is not in use, as shown, but available for initiating coiling of a further superlarge coil as continuous casting of the thin slab continues in an uninterrupted manner. Preferred operation of the thin slab continuous caster avoids interruption of continuous casting for coil handling reasons. FIG. 4*b*, schematically depicts coiling at coiling station 57 concurrent with uncoiling at uncoiling station 58. Such uncoiling step, in preparation for hot-rolling at rolling mill 40, is carried out in significantly less time than the coiling step at station 57 because of the relatively slow rate of continuous casting compared with optimum entry speed into the hot-rolling mill. Therefore, under normal operating conditions, uncoiling station 58 is not in use during final stages of coiling the continuously cast strip at station 57. The coil handler therefore, is available, following revolution, for initiating coiling of another intermediate superlarge coil with little or no delay in the continuous casting process.

Coil handlers such as 47 and 48, FIG. 3, for supporting, coiling and uncoiling at stations 57 and 58, FIGS. 4, 4*a*, and 4*b*, can include a cradle formed by driven rollers which provide a substantially uniform support for the superlarge coil, and also means for rotating the coil about its central axis for coiling and uncoiling. Such superlarge coil is formed on the handlers by mandrelless coiling means familiar to those in the art.

Another embodiment for carrying out the process of the invention is depicted in the schematic perspective drawings of FIGS. 5, 5*a* and 5*b*. Components of continuous casting, reheating, rolling and strip handling, common to the previous embodiment, are indicated with similar reference numerals. The embodiment of FIGS. 5, 5*a*, and 5*b*, is described in relation to a straight-line processing system. The coil handlers depicted in FIG. 5, at coiling station 60 and uncoiling station 61, in addition to presenting supporting, coiling and uncoiling means, feature transporting means 62 and 63 for horizontally relocating the handlers. In a preferred embodiment such means can include wheels. Such transporting means enable horizontal movement of the handlers for relocating coils to coiling and uncoiling stations as depicted in FIGS. 5, 5*a* and 5*b*. In FIG. 5, coiling of continuously cast thin slab is taking place at coiling station 60. A coil handler at uncoiling station 61 is not in use, as shown. Following completion of coiling a superlarge coil at coiling station 60 (FIG. 5), coil handler repositioning is carried out along a path generally indicated at 64. The coil handler at coiling station 60 is moved initially in a direction indicated by arrow 65 to enable immediate movement of the coil handler at uncoiling station 61 in a direction indicated by arrow 66 so as to be in position at the coiling station to initiate coiling of the next continuously cast thin slab with little or no delay in the continuous casting process. The coil handler supporting the just coiled slab continues its movement, as indicated by arrows 67 and 68 to arrive at the uncoiling station in preparation for uncoiling for entry into hot-rolling mill 40. Such repositioning of coil handlers and coils is depicted in FIG. 5*a*. FIG. 5*b* depicts a next stage of the process wherein coiling is taking place at coiling station 60 and uncoiling is taking place at uncoiling station 61. Such uncoiling for hot-rolling, absent any processing problems, is completed prior to completion of coiling the cast thin slab. Such timing enables immediate movement of a coil handler into position for coiling without significant, if any, interruption of continuous casting.

FIGS. 6, 6*a* and 6*b*, present an embodiment of the process of the invention for use with processing lines presenting a non-linear arrangement. With such arrangement, a continuous casting and reheating stage is carried out at a location generally indicated at 69 and a hot-rolling stage is carried out at a location generally indicated at 70. Such non-linear arrangement of processing apparatus is preferred when facilities of significant length to house processing equipment are not available. In FIGS. 6, 6*a* and 6*b* a path generally indicated at 71 is followed for repositioning superlarge coil handlers from coiling station 72 of the casting stage to uncoiling station 73 of the hot-rolling stage. Coil handlers in such embodiment feature supporting, coiling, transporting and uncoiling means as in the previous embodiment. FIG. 6, depicts coiling of thin cast slab 74 at coiling station 72. A coil handler at uncoiling station 73, is not in use, as shown. Following completion of coiling at coiling station 72, the coil handler is moved in a direction indicated by arrow 75 to enable immediate movement of the handler which is not in use in a direction indication by arrow 76 into position at coiling station 72 so as not to significantly interrupt the continuous casting operation. The coil handler supporting the just coiled thin slab continues movement as indicated by arrows 77 and 78. A resulting configuration is depicted in FIG. 6*a,* wherein a coil handler is positioned at coiling station 72 for initiating coiling of the continuously cast thin slab and a superlarge coil is positioned at uncoiling station 73 for uncoiling and entry of thin slab into hot-rolling mill 40. FIG. 6*b,* depicts concurrent coiling and uncoiling of superlarge coils of continuously cast thin slabs at coiling station 72 and uncoiling station 73. Timing of such coiling and uncoiling is similar to that described in relation to the previous embodiments wherein, continuous casting of thin slab is not interrupted.

FIG. 7, depicts a variation of the embodiment depicted in FIGS. 6, 6*a,* and 6*b* wherein a third coil handler located at 79, is utilized to facilitate immediate positioning of an empty coil handler into coiling station 80 along path 81 following removal of coil handler 82 in a direction indicated by arrow 83. Such embodiment can prevent a possible interruption of continuous casting in event of delays in downstream processes such as in the hot-rolling operation. Movement of coil handler 84, in readiness for moving into the coiling station, is along a path indicated by arrows 85 and 86.

While specific apparatus and process steps have been set forth for purposes of describing embodiments of the invention, various modifications can be resorted to, in light of the above teachings, without departing from applicant's novel contribution. Therefore, in determining the scope of the invention, reference shall be made to the appended claims.

What is claimed is:

1. A method of substantially uninterrupted continuous casting of thin metal slab followed by entry at optimum speed into a hot-rolling mill for producing superlarge coils of continuous length hot-rolled strip, comprising:

continuously casting an elongated thin metal slab, reheating said slab to about a temperature for hot-rolling and rolling the thin cast slab in a roughing mill to reduce its thickness gauge, coiling to form a first superlarge coil of said reduced thickness gauge continuous slab at a coiling station having positioned therein a first coil handler for supporting, coiling and uncoiling superlarge coils, then, following completion of coiling, repositioning said first superlarge coil, supported by said first coil handler from the coiling station to an uncoiling station, while simultaneously repositioning a second coil handler, positioned at the uncoiling station, to the coiling station for use in repeating said coiling step, uncoiling said first superlarge coil, for entry of reduced thickness gauge continuous slab into a hot-rolling mill, hot-rolling said reduced thickness gauge continuous slab to form hot-rolled strip, and coiling said hot-rolled strip into a finished superlarge coil.

2. The method according to claim 1, further comprising following completion of both (1) uncoiling the first superlarge coil for entry into the hot-rolling mill, and (2) coiling the reduced thickness gauge continuously cast thin slab to form a second superlarge coil, repeating said repositioning steps and said coiling and uncoiling steps in a continuing manner, so as to enable substantially uninterrupted operation of the continuous caster and enable entry of reduced thickness gauge thin cast slabs into the hot-rolling mill at optimum entry speed.

3. The method according to claim 1, wherein said finished superlarge coil is of a specific weight of between about 1500 to 8000 pounds per inch of coil width.

4. The method according to claim 1, further comprising repositioning said coil handlers for supporting, coiling and uncoiling continuous length reduced thickness gauge slabs using a revolvable turret.

5. The method according to claim 1, further comprising providing transporting means on said superlarge coil handlers for use in repositioning movement in horizontal directions.

6. The method of claim 1, wherein coiling and uncoiling of superlarge coils are carried out on mandrelless coil handlers.

7. The method according to claim 5, wherein said transporting means include wheels.

8. A method of substantially uninterrupted continuous casting of thin metal slab followed by entry at optimum speed into a hot-rolling mill for producing superlarge coils of continuous length hot-rolled strip, comprising:

continuously casting an elongated thin metal slab, reheating said slab to about a temperature for hot-rolling and rolling the thin cast slab in a roughing mill to reduce its thickness gauge, coiling to form a first superlarge coil of said reduced thickness gauge continuous slab at a coiling station having positioned therein a first coil handler for supporting, coiling and uncoiling superlarge coils, then, following completion of coiling, repositioning said first superlarge coil, supported by said first coil handler from the coiling station to an uncoiling station, while simultaneously repositioning a second coil handler, positioned adjacent the coiling station, to the coiling station for use in repeating said coiling step, and repositioning a third coil handler, positioned at the uncoiling station, to be adjacent the coiling station, uncoiling said first superlarge coil for entry of reduced thickness gauge continuous slab into a hot-rolling mill, hot-rolling said reduced thickness gauge continuous slab to form hot-rolled strip, and coiling said hot-rolled strip into a finished superlarge coil.

9. The method to claim 8, further comprising following completion of both (1) uncoiling the first superlarge coil for entry into the hot-rolling mill, and (2) coiling the reduced thickness gauge continuously cast thin slab to form a second superlarge coil, repeating said repositioning steps and said coiling and uncoiling steps in a continuing manner so as to enable substantially uninterrupted operation of the continuous caster and enable entry of reduced thickness gauge thin cast slabs into the hot-rolling mill at optimum entry speed.

10. A system for handling superlarge coils to enable substantially uninterrupted continuous casting of thin metal slab followed by entry at optimum speed into a hot-rolling mill for producing superlarge coils of continuous hot-rolled strip, comprising, in combination:

a reheating furnace for reheating a continuously cast thin metal slab to about a temperature for hot-rolling, a roughing mill for reducing thickness gauge of said reheated continuous thin metal slab, a hot-rolling mill for hot-rolling said reduced thickness gauge thin metal slab to produce hot-rolled strip, a coil handler for supporting, coiling, and uncoiling finished superlarge coils of said hot-rolled strip; and, intermediate said roughing mill and said hot-rolling mill:

a coiling station, followed in-line by an uncoiling station, a first coil handler, for supporting, coiling and uncoiling the thin metal slab, positioned at the coiling station to form a superlarge coil, a second coil handler, for supporting, coiling and uncoiling the thin metal slab, positioned at the uncoiling station for uncoiling the superlarge coil of the thin metal slab, and a means for repositioning said coil handlers following completion of both coiling and uncoiling, so as to enable continuous casting of thin metal slab in the continuous caster and enable its entry at optimum speed into the hot-rolling mill.

11. The system of claim 10, wherein said means for repositioning the coil handlers comprises a revolving turret for supporting and repositioning said coil handlers to the coiling station and the uncoiling station.

12. The system of claim 10, further comprising transporting means on said coil handlers for use in horizontally oriented repositioning of said coil handlers to the coiling station and the uncoiling station.

13. The system of claim 10, wherein the coil handlers support, coil and uncoil superlarge coils of a specific weight between about 1500 and 8000 pounds per inch of coil width.

14. The system of claim 10, wherein said first coil handler and said second coil handler are mandrelless.

15. The system of claim 11, wherein said transporting means include wheels.

16. The system of claim 12, further comprising a third coil handler, for supporting, coiling, transporting and uncoiling the thin metal slab, positioned adjacent the coiling station.

* * * * *